US008850629B2

(12) United States Patent
Vierkant, III et al.

(10) Patent No.: US 8,850,629 B2
(45) **Date of Patent: *Oct. 7, 2014**

(54) PLUMBING FIXTURE SEAT

(71) Applicant: Kohler Co., Kohler, WI (US)

(72) Inventors: Erich C. Vierkant, III, Sheboygan, WI (US); Brian M. Kaule, Sheboygan, WI (US)

(73) Assignee: Kohler Co., Kohler, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/669,074

(22) Filed: Nov. 5, 2012

(65) Prior Publication Data

US 2013/0298321 A1 Nov. 14, 2013

Related U.S. Application Data

(63) Continuation of application No. 11/473,717, filed on Jun. 23, 2006, now Pat. No. 8,312,571.

(51) Int. Cl.
*A47K 13/00* (2006.01)
*A47K 13/02* (2006.01)

(52) U.S. Cl.
CPC ..... *A47K 13/00* (2013.01); *A47K 13/02* (2013.01)
USPC ..... 4/237

(58) Field of Classification Search
CPC ..... A47K 13/00
USPC ..... 4/237–241
See application file for complete search history.

(56) References Cited

U.S. PATENT DOCUMENTS

| | | | | | |
|---|---|---|---|---|---|
| 1,206,186 | A | * | 11/1916 | Whelan | 264/162 |
| 1,208,869 | A | * | 12/1916 | Whelan | 4/234 |
| 1,253,851 | A | * | 1/1918 | Maguire | 4/237 |
| 1,829,526 | A | * | 10/1931 | Leslie | 427/210 |
| 1,863,799 | A | | 6/1932 | Loetscher | |
| 2,155,286 | A | * | 4/1939 | Winding | 4/234 |
| 2,160,100 | A | * | 5/1939 | Crawford | 4/244.3 |
| 2,185,499 | A | * | 1/1940 | Corser | 4/237 |
| 2,771,612 | A | * | 11/1956 | Samuels | 4/237 |
| 3,379,800 | A | * | 4/1968 | Wert | 264/46.4 |

(Continued)

FOREIGN PATENT DOCUMENTS

| | | |
|---|---|---|
| DE | 2209887 | 9/1973 |
| JP | 9084719 | 3/1997 |
| WO | WO 2008/002397 A2 | 1/2008 |

OTHER PUBLICATIONS

International Search Report of International Application No. PCT/US2007/013929 (WO 2008/002397) dated Jan. 15, 2005; 5 pages.

*Primary Examiner* — Lori Baker
(74) *Attorney, Agent, or Firm* — Foley & Lardner LLP

(57) ABSTRACT

A seat for a plumbing fixture includes a substantially rigid base and a cushion. The base includes an upper surface and an underside. The cushion is coupled to the base and includes a radial inward edge and a radial outward edge. At least one of the inward and outward radial edges includes a flange extending toward the other of the inward and outward radial edges, and a portion of the base is positioned above the flange to secure the cushion to the base. A lowermost portion of the at least one of the inward and outward radial edges of the cushion is flush with the underside of the base.

20 Claims, 6 Drawing Sheets

(56) References Cited

U.S. PATENT DOCUMENTS

| | | | | | |
|---|---|---|---|---|---|
| 3,513,050 | A | * | 5/1970 | Samuels et al. | 156/196 |
| 3,587,119 | A | * | 6/1971 | Freses | 4/245.5 |
| 3,623,931 | A | * | 11/1971 | Van Hosen | 156/78 |
| 3,639,922 | A | * | 2/1972 | Samuels et al. | 4/237 |
| 3,845,183 | A | * | 10/1974 | Harrison | 264/46.6 |
| 3,863,277 | A | * | 2/1975 | Harrison | 4/237 |
| 3,949,432 | A | * | 4/1976 | Ginsburg | 4/237 |
| 3,982,786 | A | * | 9/1976 | Burgin et al. | 297/284.3 |
| 3,988,789 | A | * | 11/1976 | Blount | 4/234 |
| 4,085,468 | A | * | 4/1978 | Seiderman | 4/237 |
| 4,155,127 | A | * | 5/1979 | Seiderman | 4/234 |
| 5,193,229 | A | * | 3/1993 | Smith | 4/245.5 |
| 5,442,823 | A | * | 8/1995 | Siekman et al. | 5/653 |
| 6,154,892 | A | * | 12/2000 | Hogue | 4/234 |
| 6,347,415 | B1 | * | 2/2002 | Hogue | 4/234 |
| 6,367,415 | B2 | | 12/2002 | Hoque | |
| 6,625,830 | B2 | * | 9/2003 | Lampel | 5/653 |
| 6,748,611 | B2 | * | 6/2004 | Cecchin | 4/237 |
| 8,312,571 | B2 | * | 11/2012 | Vierkant et al. | 4/237 |
| D690,403 | S | * | 9/2013 | Fullerton et al. | D23/311 |
| 2003/0024036 | A1 | * | 2/2003 | Toldo et al. | 4/237 |
| 2003/0121090 | A1 | * | 7/2003 | Cecchin | 4/234 |
| 2003/0121091 | A1 | * | 7/2003 | Cecchin | 4/237 |
| 2007/0294810 | A1 | * | 12/2007 | Vierkant et al. | 4/237 |
| 2008/0073966 | A1 | | 3/2008 | Ali et al. | |

* cited by examiner

PLUMBING FIXTURE SEAT

CROSS-REFERENCE TO RELATED APPLICATION

This application is a Continuation of U.S. patent application Ser. No. 11/473,717, filed Jun. 23, 2006 (Now U.S. Pat. No. 8,312,571), the entire disclosure of which is incorporated herein by reference.

BACKGROUND OF THE INVENTION

The present invention relates to seats mountable on toilets, bidets and the like. In particular it relates to such seats which have been modified for improved comfort, and provided with structures permitting customization of the seat.

A wide variety of toilet seats have been developed, typically in the form of rings with central holes, or horseshoe shaped structures with the opening of the horseshoe projecting forward. Many of the earlier toilet seats were made of wood or another hard material. Later seats were made of hard plastics. While these seats provided good support, they could be uncomfortable when used for an extended period, or when used by particularly sensitive individuals.

As a result the art developed a variety of cushioned toilet seats. Some of these were made of a single material which had considerable give in it to provide a mattress-like feel. However, those seats could be structurally somewhat weak. Further, they often would deform after prolonged periods of use.

The art also developed a variety of toilet seats made of multiple materials (e.g. one cushioning material and one material providing structural integrity). These multiple material seats provided some cushioning, while still permitting improved structural integrity.

Examples of such mixed material toilet seats include U.S. Pat. Nos. 1,206,186, 1,208,869, 1,829,526, 351,863,799, 2,155,286, 2,160,100, 2,185,499, 2,771,612, 3,379,800, 3,513,050, 3,623,931, 3,639,922, 3,845,183, 3,863,277, 3,949,432, 3,988,789, 4,085,468, 4,155,127, 6,154,892, and 6,748,611. See also U.S. patent application publications 2003/0121090 and 2003/0121091.

A variety of considerations come into play when designing a mixed material toilet seat. A particularly decorative exterior material may be unsuitable for use in a water environment as being subject to degradation. Also, desirable external materials may be relatively expensive, thus leading one to want to minimize the thickness of the external layer using that material.

Another concern is the overall weight of the seat. It is generally true that the heavier the seat, the greater the noise that occurs when the seat accidentally drops down onto the toilet (absent a dampering system), and the greater risk of damaging the toilet base when that occurs. Further, the more material that is used to form the seat, the greater the material cost.

Apart from these issues the optimal contact feel for one portion of the body (i.e., one's rear end) may be quite different from the optimal contact feel along another portion of the body (i.e., one's rear thigh). This may have significant comfort implications, particularly for someone suffering from arthritis or another condition providing unusual sensitivity.

Hence, further improvements are desired in connection with designing toilet seats.

SUMMARY OF THE INVENTION

According to an exemplary embodiment, a seat for a plumbing fixture includes a substantially rigid base and a cushion. The base includes an upper surface and an underside. The cushion is coupled to the base and includes a radial inward edge and a radial outward edge. At least one of the inward and outward radial edges includes a flange extending toward the other of the inward and outward radial edges, and a portion of the base is positioned above the flange to secure the cushion to the base. A lowermost portion of the at least one of the inward and outward radial edges of the cushion is flush with the underside of the base.

According to an exemplary embodiment, a seat for a plumbing fixture includes a substantially rigid base and a cushion. The base includes an inner periphery and an outer periphery. The cushion includes an inner edge and an outer edge. The cushion is removably coupled to the base to provide an upper surface of the seat. An air gap extends from an underside of the cushion to an upper surface of the base.

According to an exemplary embodiment, a seat for a plumbing fixture includes a substantially rigid base and a cushion. The base includes an inner periphery and an outer periphery. The cushion includes an inner edge and an outer edge. The cushion is removably coupled to the base to provide an upper surface of the seat. The cushion consists essentially of a single molded synthetic material that directly engages the based when the cushion is coupled to the base.

In one aspect the present invention provides a plumbing fixture seat suitable for attachment to a plumbing fixture. The seat has an upper cushion with an upper surface and radially outer and radially inward edges depending downward from the upper surface. There is also a lower base having a catch, at least a portion of the lower base being made of a material that is more rigid than at least a portion of the upper cushion. One of the edges is snapped into the catch to thereby assemble (preferably removably assembled) the upper cushion to the lower base. Preferably the catch is an undercut along the base.

In the most preferred forms the lower base can have a radially outer undercut and also a radially inner undercut, and both the radially outer and radially inner edges of the upper cushion have been snapped into respective undercuts of the lower base. A toilet seat or the like can thereby be formed.

The particular material selected for the upper cushion is not critical. It is highly preferred that it provide a somewhat cushioning feel while being able to withstand the environment to which it will be exposed. Examples of suitable materials are ethyl vinyl acetate, polypropylene and polythiourethane.

Similarly, the material selected for the base is not critical. However, since an important purpose of the base is to provide rigidity, the base should preferably be made of a material that is more rigid than a part of (preferably all of) the cushion. We prefer a grade of polypropylene for this purpose that has a high durometer.

A construction where the base and cushion can be removably snap fit together permits a single form of base to be used with multiple cushion types. This has some value at the factory (e.g. in reducing the number of SKU parts while still allowing a variety of different cushioned seats).

Further, if a single base is sold with multiple cushion elements the toilet seat can be converted by the consumer. For example, if someone prefers more support when they first purchase the seat, and then changes what they believe to be optimal (e.g. they lose a lot of weight), the consumer can at the home change the seat.

Still further customization is possible with the present invention. This can be achieved if the cushion is formed with different zonal regions of different hardness. Thus, the upper cushion may have a plurality of zones, a first of the zones being formed from a first material having a first maximum durometer, and a second of the zones being formed from a second material having a second maximum durometer higher than the first maximum durometer.

Thus, for example, the portion of the cushion adjacent the buttocks can be very soft, the portion adjacent the thigh can be of the same zone, or of a separate zone that is somewhat harder, and the remainder of the seat cushion can be even harder. This can maximize comfort for each individual, as different styles can be offered.

Still further customization is possible if the zones are separately formed, and can be separately snapped on to the base. With such a structure at least one of the zones could be separately replaced if optimal feel has changed for only, one region.

To provide a different cushioning feel the upper cushion can have at least one leg positioned between its outer and inner edges that rests on an upper surface of the lower base. It provides more support than just an air pocket. However, as there is an air cavity between the lower base and the upper cushion on each side of the leg, the weight of the design is lower.

Alternatively, the lower base and the upper cushion can contact each other in a close complementary fashion along a curved surface, such that one bulges into the other. This further solidifies the linking of the cushion and base, while maximizing the support.

In another aspect the invention provides a plumbing fixture seat suitable for attachment to a plumbing fixture where there is an upper cushion and a lower base attached to the upper cushion. The upper cushion comprises a plurality of zones, a first of said zones being formed from a first material having a first maximum durometer, and a second of said zones being formed from a second material having a second maximum durometer higher than the first maximum durometer. This is so regardless of the means of attaching the base to the cushion, albeit (as noted above) it is preferable that the base and cushion be removably linked.

In yet another form the invention provides a kit for producing a customized toilet seat. There is a lower base and a plurality of separable cushion elements that when mounted on top of the lower base are capable of forming an upper cushion for a toilet seat. The upper cushion then has a series of zones, at least one of which has a different maximum durometer than at least one of the other zones of the cushion.

In still another form of the invention the seat has an upper cushion having an upper surface and radially outer and radially inward edges depending downward from said upper surface. The upper cushion also has at least one leg positioned between said outer and inner edges. There is a lower base assembled to the upper cushion such that the leg rests on an upper surface of the lower base with an air pocket on two sides thereof.

It should be appreciated that the present invention provides a cushioned plumbing fixture seat with structural integrity, and with improved ability for customization.

These seats are inexpensive to manufacture using standard molding techniques. For example, injection molding can make the polypropylene base and also the cushion can be an injection molded ethyl vinyl acetate. After formation these parts can be assembled quite quickly (even by a consumer). Further, they permit seats of reduced weight which can still perform the needed functions of the seat, thereby reducing costs and the risk of bowl damage.

These and still other advantages of the present invention will be apparent from the detailed description and drawings. What follows are merely preferred embodiments of the present invention. To assess the full scope of the invention the claims should be looked to.

DETAILED DESCRIPTION OF THE PREFERRED EMBODIMENTS

Figure 1:
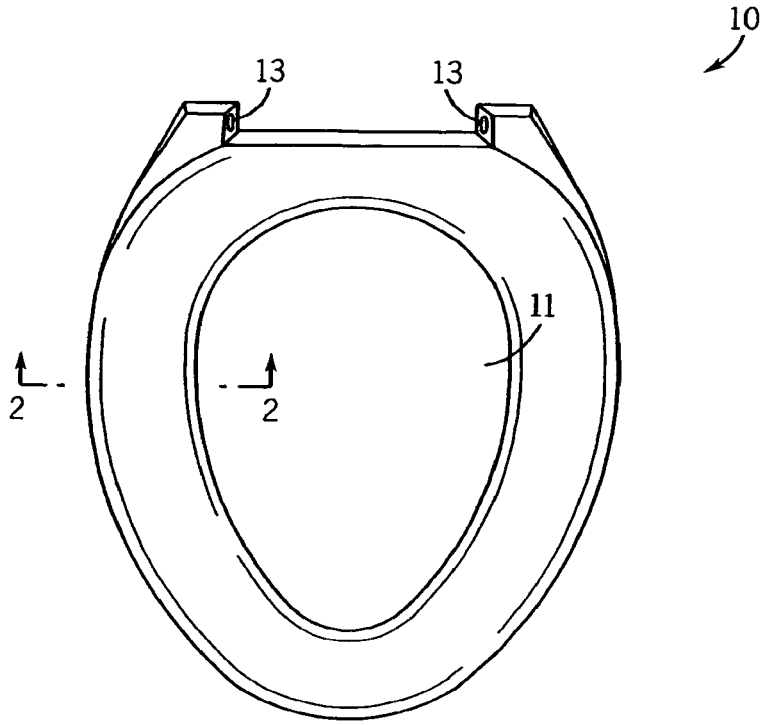
FIG. 1 is a top plan view of a plumbing fixture seat of the present invention in the form of a toilet seat.
Figure 2:
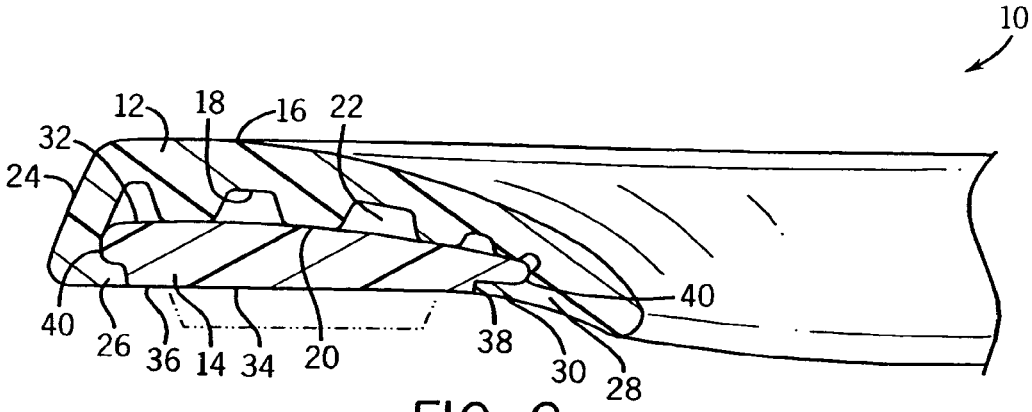
FIG. 2 is a partial sectional and partial side view taken generally along line 2-2 of FIG. 1.

Referring first to FIGS. 1 and 2, a toilet seat 10 has an upper cushion 12 connected to a supporting lower base 14. The rear of the cushion 12 can be formed with cylindrical bores 13 to accept conventional hinge posts. Alternatively, the base could be formed with the bores to accept the hinge post (not shown).

The cushion 12 is a molded synthetic material that can compress somewhat when sat upon and thereby provide a cushiony feel. It is preferably formed with an upper generally flat seating surface 16 and an opposing underside 18. In one form the underside 18 includes a series of downwardly protruding feet 20 spaced apart from each other but substantially surrounding the central hole 11. The feet 20 thereby define individual cavities/air pockets 22.

The cushion 12 also comprises a outward radial edge 24 that extends downwardly from the upper surface 16 of the cushion 12 and includes an essentially hook-like flexible flange 26. The cushion may also have a radially inwardly edge 28 that also has another hook-like flexible flange 30.

The base 14 is preferably in the form of a substantially rigid slab with an upper surface 32, an underside 34, and opposing radially inward and radially outward undercuts 38 and 40. The flanges 26 and 30 can snap into the undercuts to connect the cushion 12 with base 14.

Once assembled, the downwardly protruding feet 20 of the cushion 12 rest directly on upper surface 32 to provide support. The channels 22 defined between the protruding feet 20 lighten the weight of the fixture seat 10, while also allowing some flexing of the feet if the pressure becomes too great.

The dotted lines in FIG. 2 (and also those in FIGS. 4 and 6-12) illustrate potential further bumper members that may be integral with, or linked to, the base. However, those structures are not critical to practicing the invention.

Figure 3:
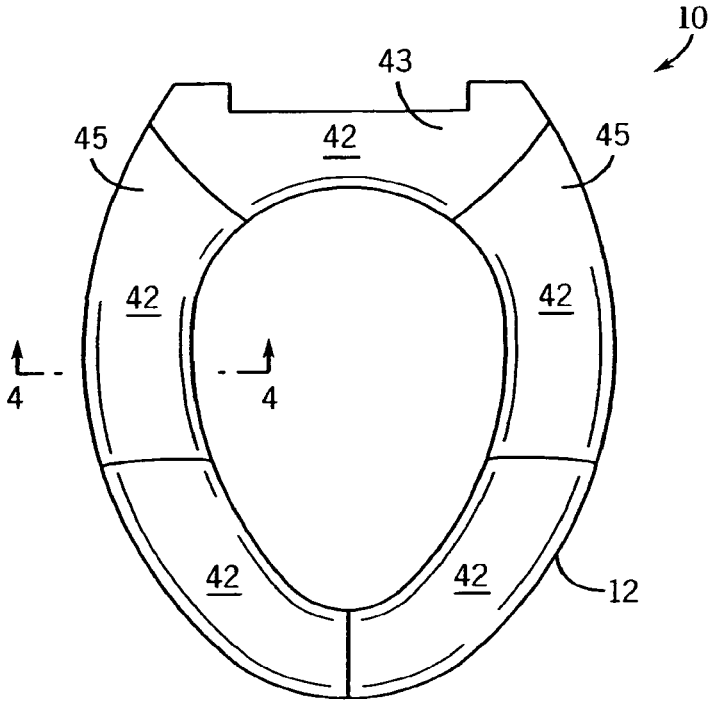
FIG. 3 is a view similar to FIG. 1, but of a second embodiment.
Figure 4:
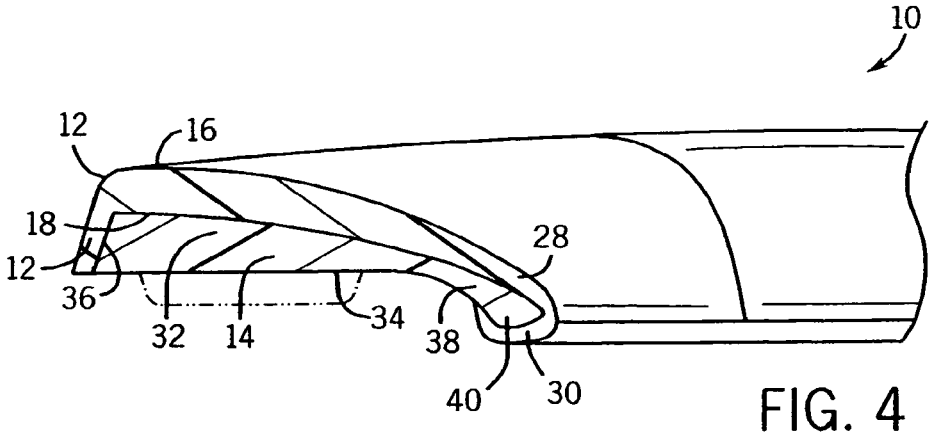
FIG. 4 is a partial sectional and partial side view similar to FIG. 1, albeit taken generally along line 4-4 of FIG. 3.

Referring next to FIGS. 3-4, a second embodiment of the plumbing fixture 10 of the present invention is shown. Similar parts are similarly numbered with respect to this embodiment, and with respect to the other embodiments. Note that here there is only one undercut 40, on the radially inward side.

The cushion 12 in FIG. 3 is comprised of various zones 42 along the circumference. Preferably, the rear zone 43 is made of a more flexible material than the zones 45. In any event, these zones can be selected from materials such as ethyl vinyl acetate, polypropylene, or polythiourethane. Other plastic and synthetic materials may also be selected which have a cushiony feel plus the other desired characteristics for the environment.

Figure 5:
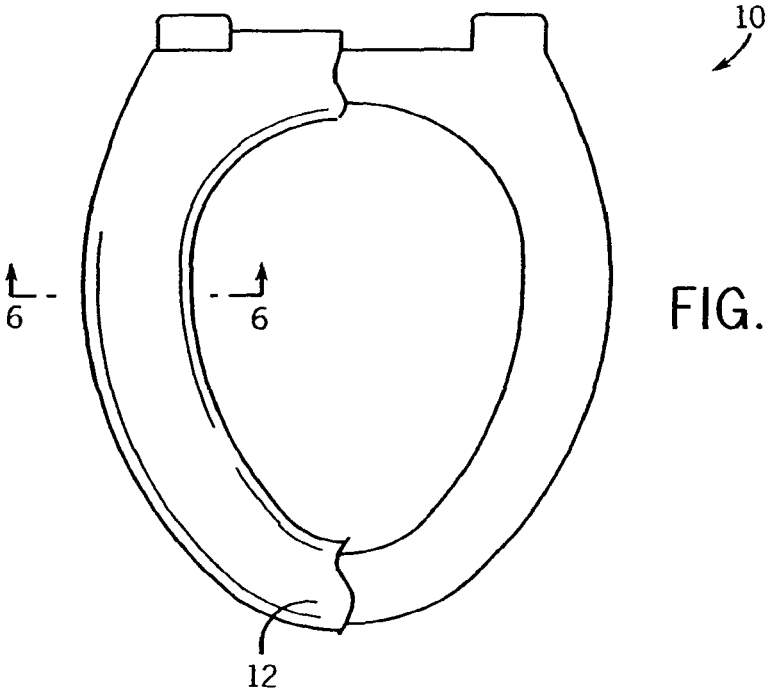
FIG. 5 is another view similar to FIG. 1, but of a third embodiment, and with a portion broken away.
Figure 6:
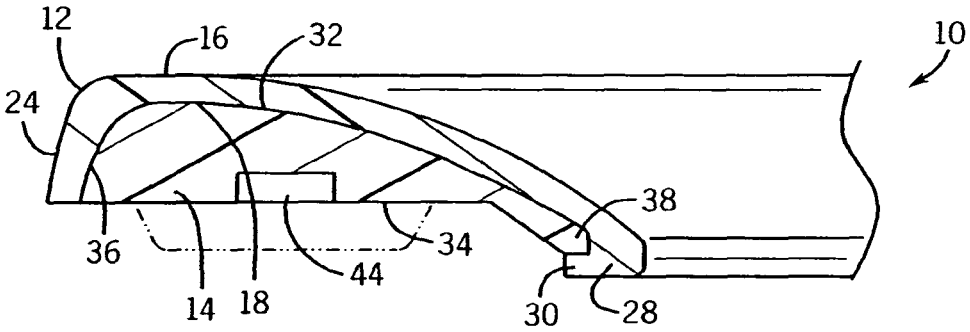
FIG. 6 is a partial sectional and partial side view similar to FIG. 1, albeit taken generally along line 6-6 of FIG. 5.

Referring next to FIGS. 5 and 6, the form of snap fit connection is slightly different because of the less slab-like nature of the base. Groove 44 shows that some weight can be reduced in this configuration.

Figure 7:
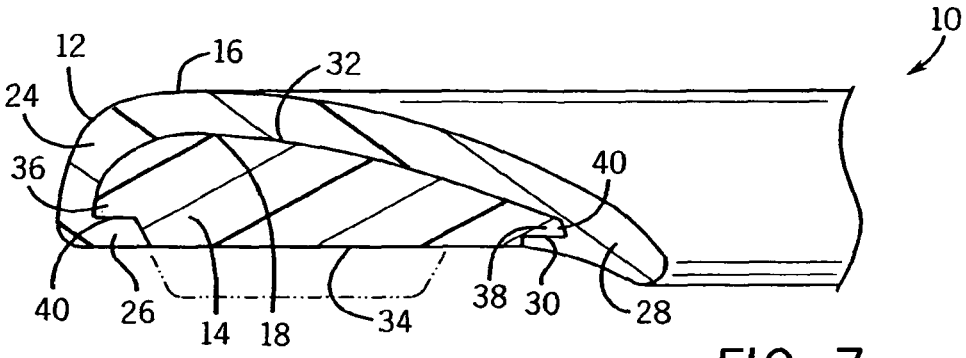
FIG. 7 is a partial sectional and partial side view similar to FIG. 1, albeit of a fourth embodiment.
Figure 8:
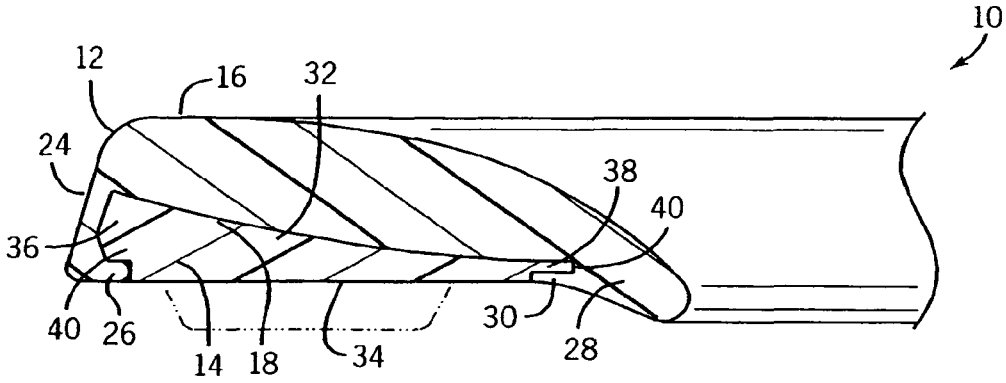
FIG. 8 is a partial sectional and partial side view similar to FIG. 1, albeit of a fifth embodiment.

As seen in FIG. 7 the air pockets can be removed, and if desired a convex/concave contact relationship can be between the contacting surfaces of the base and cushion. Here, the base bulges into the cushion. In contrast, as seen in FIG. 8, the cushion can instead bulge into the base.

Figure 9:
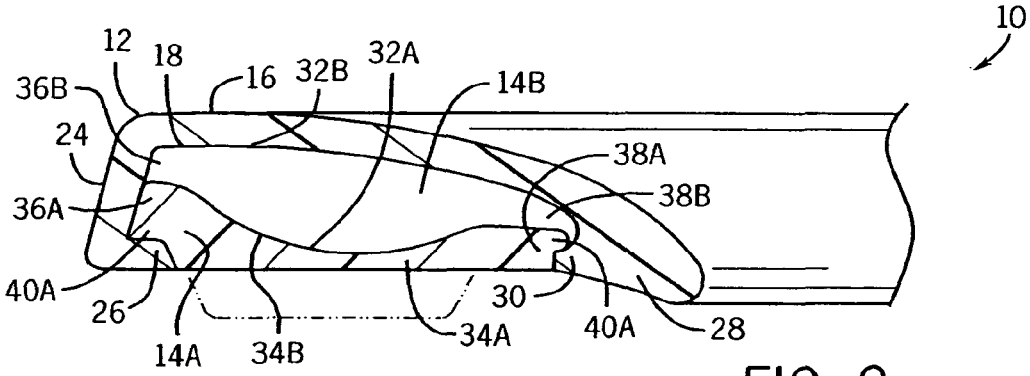
FIG. 9 is a partial sectional and partial side view similar to FIG. 1, albeit of a sixth embodiment.

In FIG. 9, there is a base 14A having a substantially concave upper surface 32A and an underside 34A, and an insert 14B, having a upper surface 32B and a convex underside 34B. The underside 34A of the base 14A includes an edge 36A having an undercut 40A that matingly engages with the flange 26 of the cushion 12. There is also an -Undercut 38A that engages flange 30 of the cushion 12. Hence, instead of relying on an air pocket to alter cushion feel, a customizable insert element 14B can be provided, and changed over time, without the need to alter the base or cushion.

Figure 10:
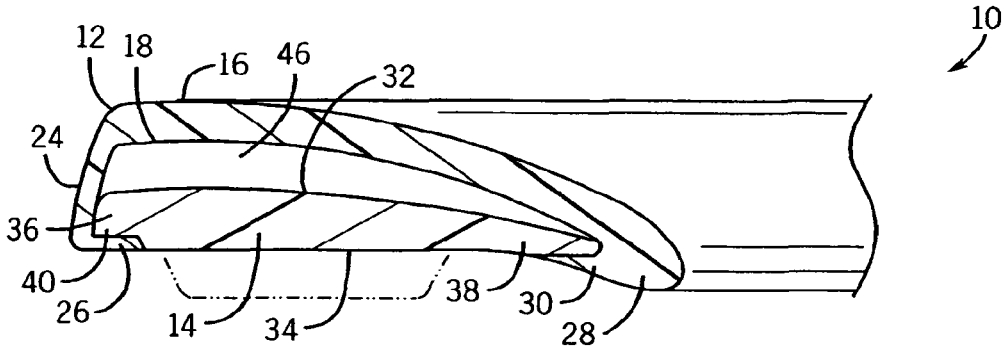
FIG. 10 is a partial sectional and partial side view similar to FIG. 1, albeit of a seventh embodiment.

In FIG. 10, the concept is similar except that there is no insert and only an air pocket 46 to provide interim support.

Figure 11:
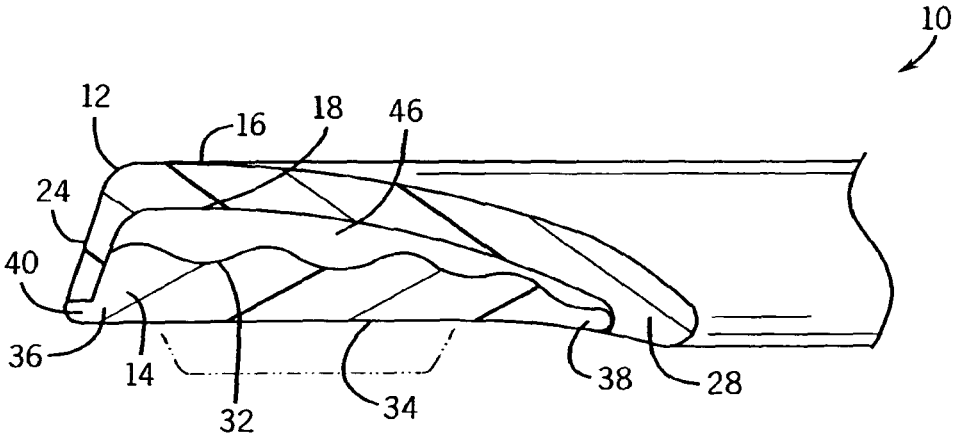
FIG. 11 is a partial sectional and partial side view similar to FIG. 1, albeit of an eighth embodiment.

In FIG. 11, the base has an undulating upper surface which provides limits to the degree of deformation of the cushion, than in FIG. 10.

Figure 12:
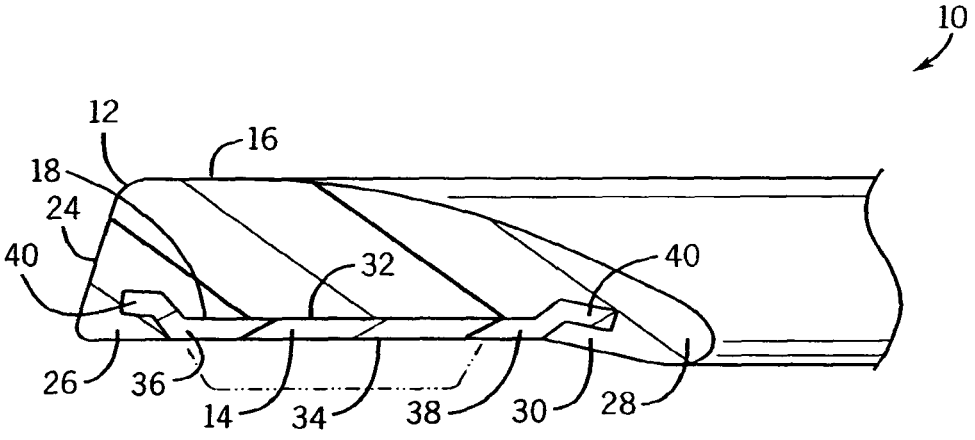
FIG. 12 is a partial sectional and partial side view similar to FIG. 1, albeit of a ninth embodiment.

In FIG. 12, a slightly different base structure is shown, and the complementary cushioning has a corresponding shape.

Figure 13:
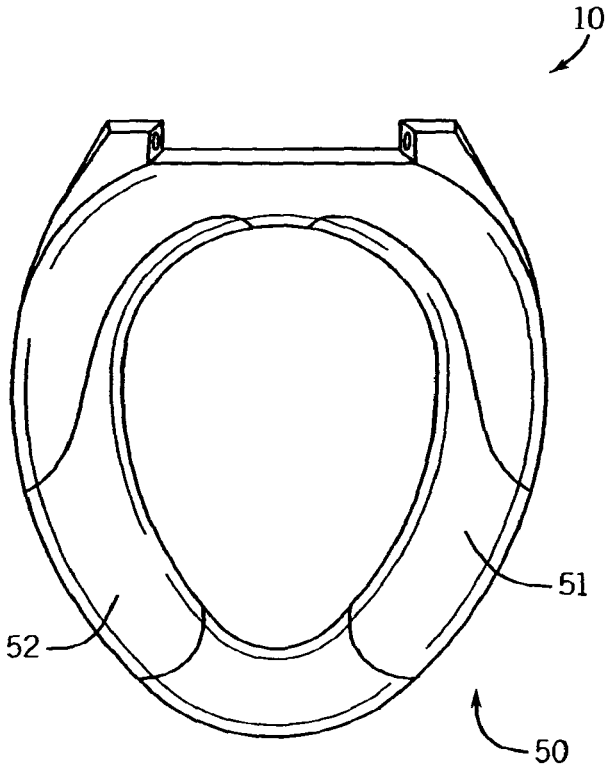
FIG. 13 is a view similar to FIG. 3, albeit of another embodiment with different zonal regions.

In FIG. 13 we show another embodiment 50 where the zonal regions 51 and 52 extend along the thigh area and part of the buttocks area, rather than simply being defined by radial severing lines.

It should be appreciated that preferred embodiments of the invention have been described above and depicted in the enclosed drawings. However, many modifications and variations to the preferred embodiments will be apparent to those skilled in the art, which will be within the spirit and scope of the invention. For example, while the invention has been depicted in the context of a toilet seat, it could also be used for a seat for other plumbing fixtures. The invention could be in the form of a bidet seat, a seat associated with a bath tub, or serve another seating purpose associated with plumbing fixtures.

Therefore, the invention should not be limited to just the described embodiments. To ascertain the full scope of the invention, the following claims should be referenced.

INDUSTRIAL APPLICABILITY

The invention provides plumbing fixture seats, such as toilet seats, which can be customized.

We claim:

1. A seat for a plumbing fixture, comprising:

a substantially rigid base having an upper surface and an underside;

a cushion coupled to the base, the cushion having an inward radial edge and an outward radial edge;

wherein at least one of the inward and outward radial edges includes a flange extending toward the other of the inward and outward radial edges, and a portion of the base is positioned above the flange to secure the cushion to the base; and wherein a lowermost portion of at least one of the inward and outward radial edges of the cushion is flush with the underside of the base.

2. The seat of claim 1, wherein a lower surface of the cushion engages the upper surface of the base, and an air pocket is defined between the lower surface of the cushion and the upper surface of the base.

3. The seat of claim 1, wherein the outward radial edge includes an outer flange extending toward the inner radial edge, and an outer periphery of the base is positioned above the outer flange to secure the cushion to the base.

4. The seat of claim 3, wherein a lower surface of the flange is flush with the underside of the base.

5. The seat of claim 3, wherein the inner radial edge includes an inner flange extending toward the outer radial edge, and an inner periphery of the base is positioned above the inner flange to secure the cushion to the base.

6. The seat of claim 1, wherein the upper surface of the base is generally concave, the cushion includes a lower surface that is generally convex, and the lower surface of the cushion engages the upper surface of the base.

7. The seat of claim 1, wherein the upper surface of the base is generally convex, the cushion includes a lower surface that is generally concave, and the lower surface of the cushion engages the upper surface of the base.

8. The seat of claim 1, further comprising an insert is positioned between the upper surface of the base and a lower surface of the cushion.

9. The seat of claim 1, wherein the upper surface of the base includes one or more undulations, and an air space is defined between the upper surface of the base and a lower surface of the cushion.

10. The seat of claim 1, wherein the cushion is removably coupled to the base.

11. The seat of claim 1, wherein the cushion comprises different regions of molded synthetic material having different durometers.

12. The seat of claim 11, wherein the different regions of the cushion are separately removable from the base.

13. A seat for a plumbing fixture, comprising:

a substantially rigid base having an inner periphery and an outer periphery; and a cushion having an inner edge and an outer edge, the cushion being removably coupled to the base to provide an upper surface of the seat;

wherein an air gap extends from an underside of the cushion to an upper surface of the base.

14. The seat of claim 13, wherein a portion of an underside of the cushion directly engages an upper surface of the base.

15. The seat of claim 14, wherein the underside of the cushion includes downwardly protruding feet that are configured engage the upper surface of the base and are spaced apart to define a cavity between the underside of the cushion and the upper surface of the base.

16. The seat of claim 15, wherein the upper surface of the base includes one or more undulations between the inner periphery and the outer periphery.

17. The seat of claim 13, wherein an insert element is positioned between the underside of the cushion and the upper surface of the base.

18. A seat for a plumbing fixture, comprising:

a substantially rigid base having an inner periphery and an outer periphery; and a cushion having an inner edge and an outer edge, the cushion being removably coupled to the base to provide an upper surface of the seat;

wherein the cushion consists essentially of a single molded synthetic material that directly engages the base when the cushion is coupled to the base.

19. The seat of claim 18, wherein an air gap extends from an underside of the cushion to an upper surface of the base.

20. The seat of claim 18, wherein the single molded synthetic material comprises at least one of ethyl vinyl acetate and polythiourethane.

* * * * *